US005791363A

United States Patent [19]

Moses

[11] Patent Number: 5,791,363

[45] Date of Patent: Aug. 11, 1998

[54] KNOCKDOWN PORTABLE SHELTER

[76] Inventor: Allen Moses, 682 E. 7th St., Brooklyn, N.Y. 11218

[21] Appl. No.: 851,904

[22] Filed: May 6, 1997

Related U.S. Application Data

[63] Continuation of Ser. No. 439,117, Aug. 9, 1995, abandoned.

[51] Int. Cl.[6] ..... E04H 15/48

[52] U.S. Cl. ..... 135/143; 135/156; 135/902; 135/115

[58] Field of Search ..... 135/128, 143, 135/144, 156, 148, 149, 909, 902, 900, 115; 403/287, 299, 361

[56] References Cited

U.S. PATENT DOCUMENTS

| | | | |
|---|---|---|---|
| 1,528,629 | 3/1925 | Quinan et al. . | |
| 2,010,472 | 8/1935 | Angel . | |
| 2,511,452 | 6/1950 | Anderson et al. . | |
| 2,619,101 | 11/1952 | McGerry et al. . | |
| 2,882,913 | 4/1959 | Beauregard | 135/904 X |
| 3,407,546 | 10/1968 | Yates et al. | 135/115 X |
| 3,424,178 | 1/1969 | Yazaki | 135/909 X |
| 3,476,127 | 11/1969 | Holt . | |
| 3,709,237 | 1/1973 | Smith | 135/115 X |
| 3,800,814 | 4/1974 | Hibbert . | |
| 3,847,170 | 11/1974 | Anderson | 135/148 X |
| 4,140,141 | 2/1979 | Marks | 135/909 X |
| 4,821,353 | 4/1989 | Neri . | |
| 5,080,123 | 1/1992 | Stein | 135/115 X |
| 5,167,246 | 12/1992 | Mortenson | 135/143 X |
| 5,172,447 | 12/1992 | Tomm | 403/299 X |
| 5,261,436 | 11/1993 | Funk | 135/156 |

*Primary Examiner*—Lanna Mai

*Attorney, Agent, or Firm*—Lackenbach Siegel Marzullo Aronson & Greenspan, P.C.

[57] ABSTRACT

A knockdown portable shelter includes two spaced supports each formed of elongated members that can be separated from each other at couplings securing the elongated members to each other. The elongate members include leg portions and a roof portion. A sheet like covering material extends between the roof portion of the spaced supports and at least parts of the leg portions. The covering material is substantially more pliable along the direction extending between the two spaced supports than along a perpendicular direction. Hinges allow folding of the material along lines extending between corresponding couplings. Disconnection of elongate members at the couplings allows the covering material to be folded along the hinges and rolled up along the direction extending between the supports. One example of a suitable covering material is single face corrugated hollow core material. The elongate members are preferably hollow plastic tubes and the couplings are hollow plastic elbows made of PVC.

18 Claims, 2 Drawing Sheets

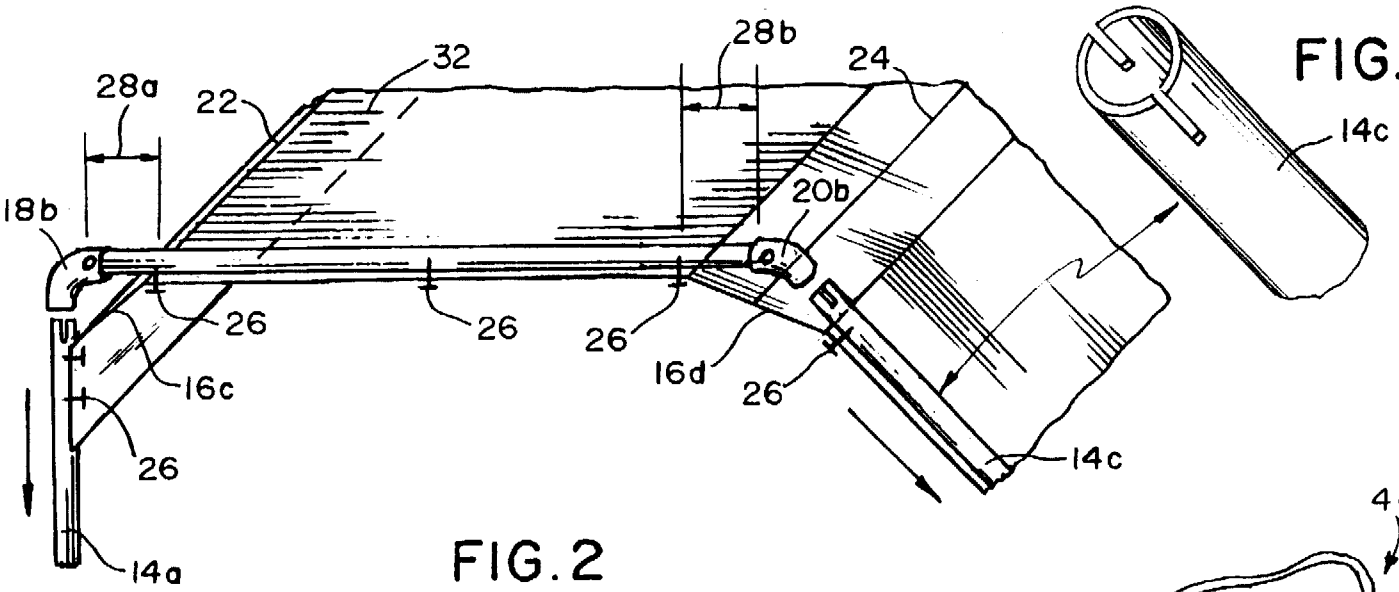
FIG. 3
FIG. 2
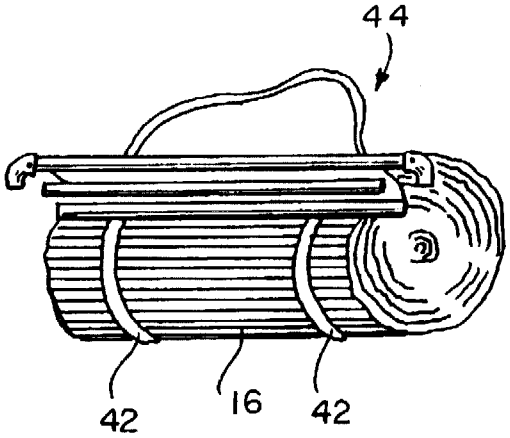
FIG. 5
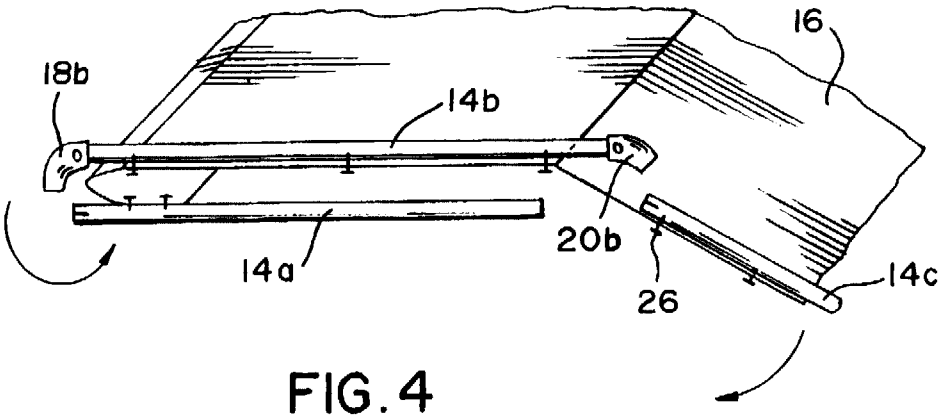
FIG. 4

KNOCKDOWN PORTABLE SHELTER

This application is a continuation of application Ser. No. 08/439,117, filed Aug. 9, 1995.

BACKGROUND OF THE INVENTION

This invention generally relates to portable shelters and, more specifically, to a knockdown portable shelter which requires limited support structures.

Various portable shelters have been proposed for numerous different applications. Thus, in U.S. Pat. No. 2,511,452 a shelter for hunters is disclosed which is readably collapsible into a small, light pack capable of being carried from place to place and quickly assembled. The shelter is formed of tubular members which include various elbow fittings to form a generally three dimensional structure which includes both longitudinal and transverse members for supporting a fabric material such as canvas. However, because canvas is generally a soft material, a three dimensional structure must be provided for supporting the canvas all about the frame of the structure to prevent drooping and collapse thereof.

In U.S. Pat. No. 2,010,472, a beach accessory is disclosed which is intended to be set up on the beach to provide a shelter within which to change one's apparel as well as to provide protection from the direct rays of the sun. Here, also, the covering material is in the form of pliable canvas, duck or other waterproof material. Because the covering material has no body, in any direction, the shelter requires the use of a frame which consists of both longitudinal and transverse members to define a three dimensional rigid structure. Other similar structures which require a three dimensional frame are disclosed in U.S. Pat. Nos. 1,528,629 and 2,619,101.

Portable roll up tents which use similar covering materials are disclosed in U.S. Pat. Nos. 3,476,127 and 3,800,814. Due to the nature of the covering materials these rollup tents also require added supports in order to maintain the tents in assembled conditions during use. However, in all the aforementioned patents the covering material is pliable and does not provide any support or rigidity to the assembled structure.

In U.S. Pat. No. 4,821,353 a beach mate with an adjustable sun shade is disclosed. The patentee states that the mat can be of a woven grass, plastic or canvas with appropriate rigidity characteristics. However, the structure for providing the sun shade is formed of flexible materials such as battans, fiberglass or other rigid members which must be bent into the desired shape. Additionally, in order to roll up the entire structure these rigid structural members must be pivotally rotated into a boom which is in the form of a tube for receiving these members. The mat appears to be flexible along a longitudinal direction of the beach mat and not along a transverse direction thereof, and uses the aforementioned flexible bows in conjunction with bow strings for maintaining the bows in flexed conditions during use.

SUMMARY OF THE INVENTION

Accordingly, it is an object of the present invention to provide a knockdown portable shelter which does not have the disadvantages inherent in the prior art structures.

It is another object of the present invention to provide a shelter as in the previous object which is simple in construction and economical to manufacture.

It is still object of the present invention to provide a shelter of the type under discussion which reduces the number of structural supports necessary to support a covering or protective sheet material which itself contributes to the structural integrity of the shelter.

It is yet another object of the present invention to provide a portable shelter as in the previous objects which can be readily assembled and knocked down, with minimum time and effort.

In order to achieve the above objects, as well as other which will become apparent hereafter, a knockdown portable shelter in accordance with the present invention generally comprises two spaced supports. Each support is formed of a plurality of elongate members. Coupling means is provided for releasably connecting adjacent ones of said elongate members in each of said supports. Said supports define generally downwardly extending leg portions and a roof portion extending between associated leg portions. Said supports are arranged in generally parallel planes spaced from each other along a predetermined direction. Sheet-like covering means is provided extending between said roof portions and at least corresponding parts of said leg portions, said covering means being substantially more pliable along said predetermined direction than along a direction generally orthogonal to said predetermined direction. Hinge means is provided extending between associated coupling means. In this manner, disconnection of connected elongate members of each support at said coupling means allows collapse of said supports from an assembled state and folding of same into proximate positions and subsequent rolling up of one support relative to another to wind said covering means into a roll having an axis essentially parallel to said orthogonal direction.

In accordance with the presently preferred embodiment, said elongate members are formed of PVC tubes and said coupling means are formed of PVC elbows, and said sheet-like covering means is formed of a corrugated plastic sheet material in the form of a single face hollow corrugated core plastic sheet.

BRIEF DESCRIPTION OF THE DRAWINGS

Other objects and advantages of the present invention will become apparent upon reading of the following detailed description of the preferred embodiment of the present invention when taken in conjunction with the drawings, as follows:

FIG. 2 is a fragmented section of the shelter shown in FIG. 1, illustrating the details during disassembly or collapsing of the shelter from the assembled state;

FIG. 3 is a fragmented perspective view of one of the tubes showing a slotted end;

FIG. 4 is generally similar to FIG. 2 but showing a subsequent state of disassembly; and FIG. 5 is a perspective view of the shelter in its fully collapsed or disassembled state and rolled up to render same readily transportable.

DESCRIPTION OF A PREFERRED EMBODIMENT

Figure 1:
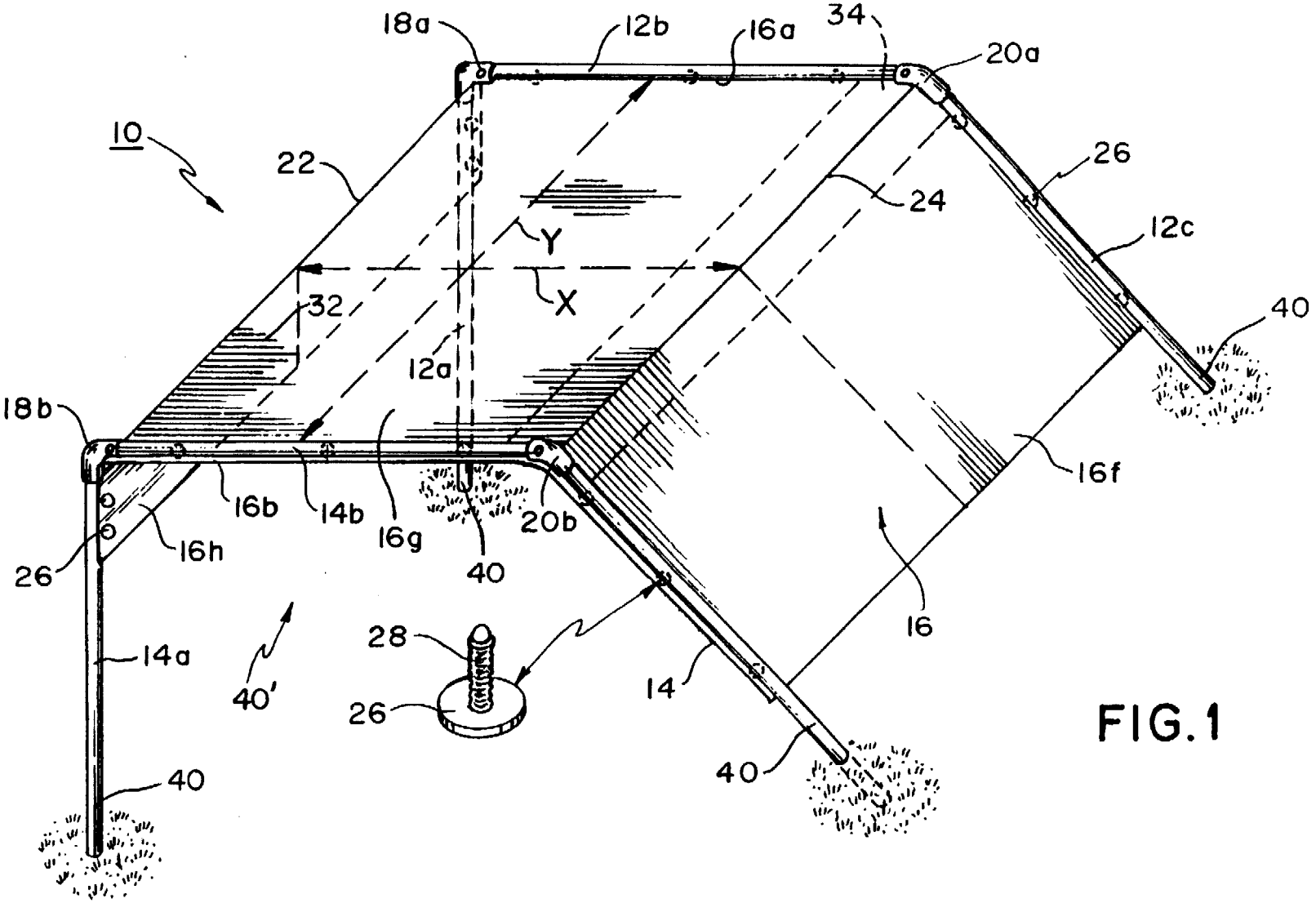
FIG. 1 is a perspective view of a knockdown portable shelter in accordance with the present invention, shown in the assembled state.

Referring now specifically to the Figures, in which the identical or similar parts are designated by the same reference numeral throughout, and first referring to FIG. 1, a knockdown portable shelter in accordance with the present invention is generally designated by the reference numeral 10.

The shelter 10 is formed of two spaced supports 12, 14 each of which is formed of a plurality of like elongate members. The support 12 is formed of elongate members 12*a*, 12*b* and 12*c*, while the support 14 is formed of corresponding elongate members 14*a*, 14*b* and 14*c*. The elongate members of each of the supports are joined to each other by suitable couplings for releasably connecting corresponding elongate members in each of the supports. The supports 12, 14 generally downwardly extending leg portions 12*a*, 14*a* and 12*c*, 14*c* and roof portions 12*b*, 14*b* which extend between the associated leg portions. The specific inclinations or angles of the various leg portions is not critical for the purposes of the present invention. In the presently preferred embodiment, the leg portions 12*a*, 14*a* are generally vertical in the assembled state, while the leg portions 12*c*, 14*c* are inclined outwardly 45° in relation to the vertical direction, as shown. The roof portions 12*b*, 14*b* are preferably horizontal. It will be evident to those skilled in the art that the specific inclinations of the various leg and roof portions can be modified to provide slightly different shapes and sizes of the frames for the shelters.

The elongate members of each of the spaced supports are advantageously arranged in a plane during normal use, and the supports 12, 14 are arranged in generally parallel planes spaced from each other along a predetermined direction X. A sheet-like covering material or panel 16 extends between the roof portions 12*b*, 14*b* and at least parts of the leg portions 12*a*, 14*a* and 12*c*, 14*c*. The covering material 16 is formed of a material which is substantially more pliable along the predetermined or transverse direction X extending between the spaced support than along a direction Y generally orthogonal to the predetermined direction X. Thus, the covering material 16 is more subject or susceptible to bending and folding as the material is rolled in the direction X of one support towards the other than in a direction Y perpendicular to that direction. While any material that has this property may be use, a presently preferred material is preferably in the form of corrugated or ribbed plastic sheet material and in the form of a single face hollow core plastic sheet material distributed by Diversi-Plast Products of Minneapolis, Minn. The corrugations or ribs are designated by the reference numeral 32 which extend along the direction X.

Suitable couplings or connecting members are provided for releasably connecting corresponding adjacent ones of the elongate members in each of the supports. Thus, right angle couplings 18*a*, 18*b* are used to connect the leg portion 12*a*, 14*a* and roof portions 12*b*, 14*b*. Where the leg portions 12*a*, 14*a* are vertical and the roof portions 12*b*, 14*b* are horizontal, the couplings 18*a*, 18*b* are preferably right angle couplings. Couplings 20*a*, 20*b* are used to join adjacent roof portions 12*b*, 14*b* and leg portions 12*c*, 14*c* as shown. Where the leg portions 12*c*, 14*c* are inclined outwardly at a 45° angle from the vertical, the couplings 20*a*, 20*b* are in the form of 135° elbows.

In the preferred embodiment, the various leg and roof portions are formed of PVC tubing, while the couplings for connecting for connecting the tubes together are in the form of PVC elbows. As suggested in FIG. 3, by slitting the ends of the tubes, insertion of the tubes into the elbows is facilitated.

Since the sheet-like corrugated material 16 does not readily bend along the longitudinal direction Y of the structure, there are advantageously provided suitable hinges 22, 24 which allows the sheet material 16 to follow and generally assume the configuration of the tubular supports. The hinge 22 extends between the right angle couplings 18*a*, 18*b*, while the hinge 24 extends between opposing elbow or couplings 20*a*, 20*b*. In this manner, the covering sheet material or panel 16 follows and assumes the general angles defined by the elbows or couplings.

While each support has been shown to be in the form of three elongate members this is not a critical limitation and the invention can be practiced with fewer or a greater number of elongate members.

The corrugated covering sheet or panel 16 includes opposing longitudinal edges 16*a*, 16*b* arranged in proximity to an associated spaced support. Thus, in the assembled state, the longitudinal edge 16*a* generally follows the contour of the support 12, while the longitudinal edge 16*b* generally follows the contour of the support 14. The edges of the covering panel may be attached to their respective supports in any conventional or suitable way. One example is the provision of series of spaced holes in each of the longitudinal edges and corresponding drilled holes within the spaced supports, so that suitable plastic rivets 26 may be used which have serrated or ribbed shanks 28 which can be forced into the holes drilled in the support and be retained therein. One feature of the present invention is that after the covering sheet or panel 16 is connected to the support structure it need not be disconnected or separated therefrom during disassembly, as with numerous prior art arrangements. Therefore, the specific method of fastening used is not critical and other fasteners such as screws, bolts, etc. can be used.

Referring to FIG. 2, the portions 16*c*, 16*d* of the edges 16*a*, 16*b* which bridge the respective couplings 18*a*, 18*b*, 20*a*, 20*b* are free from the supports. Therefore, the rivets 26*c* are spaced a distance 28*a*, 28*b* from the respective couplings to facilitate separation and disconnection of the elongate members from each other. The free edge portions 16*c*, 16*d* provide sufficient slack so that when the ends of the elongate members are removed from the associated couplings, these unconnected portions allow sufficient maneuverability do so.

It will be clear that the stiffer or more rigid (i.e. more resistant to bending) that the covering sheet material or panel 16 is along the longitudinal direction Y, i.e., the direction 30 of the ribs 32, the less the drooping of the covering sheet material or panel in that direction. However, because the ribs 32 make the sheet material or panel 16 more pliable along the direction X from one of the support 12 to the other support 14, there is a possibility of drooping between these supports. This is particularly true with lighter weight materials. In accordance with the presently preferred embodiment, the weight of the single face corrugated polyethylene plastic sheet material is between 150–200 pounds per 1,000 square feet of material. While this is the preferable range, heavier materials can be used. This would, however, increase the weight of the shelter which is intended to be portable. Lighter materials can be also be used. While this would render the total shelter lighter and more transportable, it would weaken the assembled structure, and provide more drooping. In the case of lighter materials, it is possible to minimize undesired drooping along the direction X between the spaced supports by providing at least one rigid region or reinforcement 34 which extends between an associated pair of couplings 20*a*, 20*b*. Such a reinforcement 34 can also be provided along the hinge 22. White the reinforcement 34 is shown to each side of the hinge 24 it will also be evident that reinforced regions in the form of elongate transverse strips of stiffer material can be provided across other regions of the corrugated sheet or panel 16. Generally, such reinforcement portions would have the same properties as the rest of the corrugated sheet or panel 16 in order to render same more pliable along the direction X between the spaced supports than along the direction Y which is the direction of the corrugations 32 (generally orthogonal to the direction X of the hinges.) One approach for providing the reinforcements is to use the same material as the covering sheet or panel but make it of heavier weight or thickness.

The operation or use of the shelter will now be described. In FIG. 1, the shelter 10 is shown in its fully assembled state as during normal use. The lower free ends 40 of the leg portions, namely the vertical tubes 12*a*, 14*a* and the inclined leg portions or tubes 12*c*, 14*c* are supported on the ground. When used on the beach, these free ends 40 of the legs portions typically penetrate the surface of the sand and can be forced into the sand to provide better anchoring against external forces such as the wind. The sizes and the inclinations of the various leg portions, as well as the size of the roof of the shelter determine the size of the protected area 40 below the covering sheet or panel 16. By making the panel 16 opaque it can provide protection from the rays of the sun. Clearly, different materials having different properties can be used for this purpose to accommodate the specific application or usage for which the shelter is to be used.

Referring to FIG. 2, the first step in the disassembly procedure is illustrated. The inclined tube 14*c* is pulled downwardly relative to the coupling 20*b* so as to separate these elements or members. Similarly, the vertical tube 14*a* is pulled downwardly in relation to the right angle coupling 18*b* so as to separate these members or elements as well. The free or slack regions 16*c*, 16*d* allow these members to be moved relative to each other. In FIG. 4, the vertical tube 14*a* is shown rotated in a counter-clockwise direction so as to position same below and in close proximity to the horizontal tube 14*b*. Also shown in FIG. 4 is the initial movement of the inclined tube 14*c* in a clockwise direction so as to place it proximate or next to the vertical tube 14*a*. These movements are made possible by the hinges 22, 24 which allow the bending of the covering sheet material or panel 16 notwithstanding the generally rigid nature of the material along the direction of the ribs 32. The same disassembly steps are taken in connection with the support 12. In order to rotate the leg portions as suggested in FIGS. 2 and 4 both associated couplings, on each side of the hinges, must be separated from the associated elongate members. Once the leg portions are substantially adjacent and coextensive to the horizontal tubes 12*b*, 14*b* the shelter can be rolled up as suggested in FIG. 5 by rolling up the covering sheet material or panel 16 by using the corrugations 32 as distributed hinge points each of which renders the material flexible along lines parallel to the direction X of the ribs 32.

Once the shelter is rolled up as shown in FIG. 5, suitable ties or straps 42 may be used to maintain the structure in a rolled up condition. An optional shoulder strap 44 may be used as shown to facilitate carrying of the shelter.

Numerous modifications may be made which will become evident with those skilled in the art. For example, the inclined panel portion 16*f* may extend along the entire lengths of the inclined tubes 12*c*, 14*c* or only partially, as shown in FIG. 1. The same is true of the vertical panel portion 16*h* which is shown to extend only partially down the vertical tubes 12*a*, 14*a*. However, the vertical panel portion 16*h* can be lowered to provide more protection from that side of the shelter. Also, while hollow tubular members are shown used in conjunction with hollow elbows, other elongate members and different types of connectors may be used. However, it is found that the hollow structures made of plastic PVC material provide the requisite strength and lightness of weight.

While this invention has been described in detail with particular reference to a preferred embodiment thereof, it will be understood that variations and modifications will be effected within the spirit and scope of the invention as described herein and as defined in the appended claims.

I claim:

1. Knock down portable shelter comprising two spaced supports, each support being formed of a plurality of elongate members; coupling means for releasably connecting corresponding adjacent ones of said elongate members in each of said supports, said supports defining spaced generally downwardly extending leg portions and roof portions extending between said leg portions to form a shelter space below said roof portions said supports being arranged exteriorly of said shelter space and in generally parallel planes spaced from each other along a predetermined direction; and a substantially rectangular sheet of covering material having opposing longitudinal edges and extending between said roof portions and at least parts of said leg portions, said sheet of covering material being pliable along said predetermined direction and more rigid along a direction generally orthogonal to said predetermined direction, the pliability of said sheet of covering material along said predetermined direction being such that said sheet can be substantially continuously bent along lines normal to said predetermined direction the entire distance between said spaced supports whereby said sheet of covering material can be readily rolled into a helical or spiral roll with an axis normal to said predetermined direction; fastener means for attaching each one of said opposing longitudinal edges of said rectangular sheet of covering material to an associated one of said spaced supports; hinge means on said sheet of covering material extending between associated coupling means rendering said covering material foldable between said coupling means in a direction normal to said predetermined direction and forming folded surfaces in said sheet of covering material for stiffening the same to minimize drooping of said sheet of covering material along said predetermined direction in the assembled shelter, disconnecting of connected elongate members of each support at said coupling means allowing collapse of said elongate members of each support from an assembled state by folding said sheet of covering material about said hinge means and said leg portions into said shelter space, within said parallel planes, relative to associated roof portions to position said leg portions and said roof portions in proximity to each other on opposite sides of said covering material while said panel portions are substantially co-planar and subsequently rolling of one support relative to another support along said predetermined direction to roll said covering means into a roll containing said elongate members and having an axis essentially parallel to said orthogonal direction.

2. A shelter as defined in claim 1, wherein each support is formed of three elongate members releasably connected by two couplers forming said coupling means.

3. A shelter as defined in claim 2, wherein one coupler of each support is a 90° elbow and another coupler of each support is a 135° elbow.

4. A shelter as defined in claim 1, wherein said sheet like covering means comprises corrugated sheet material having corrugated ribs extending in said orthogonal direction.

5. A shelter as defined in claim 4, wherein said corrugated sheet material is formed of plastic.

6. A shelter as defined in claim 5, wherein said corrugated sheet material comprises a single face hollow core plastic sheeting.

7. A shelter as defined in claim 1, wherein said sheet-like covering material is formed of plastic, and said hinge means comprise plastic hinges.

8. A shelter as defined in claim 1, wherein said covering sheet material has weight up to 200 pounds per 1,000 square feet.

9. A shelter as defined in claim 1, wherein said sheet-like covering means is attached to said spaced supports by rivets.

10. A shelter as defined in claim 9, wherein said rivets are plastic rivets.

11. A shelter as defined in claim 1, wherein said coupling means comprises corresponding pairs of couplings on each of said two spaced supports, and further comprising reinforcement means extending between corresponding pairs of couplings maintaining the spacing of said supports in the assembled state of the shelter and preventing drooping of said covering means along said predetermined direction during use of the shelter.

12. A shelter as defined in claim 11, wherein said reinforcement means comprises regions of increased thickness of said covering means.

13. A shelter as defined in claim 1, wherein portions of said edges proximate to said coupling means are free from and unconnected to said spaced supports to facilitate separation and disconnection of said elongate members.

14. A shelter as defined in claim 1, wherein said coupling means are tubular elbows and said elongate members have slotted ends to facilitate insertion into said tubular elbows.

15. A shelter as defined in claim 1, further comprising strap means connected to at least one of said elongate members to facilitate carrying of said shelter in a disassembled state thereof.

16. A shelter as defined in claim 1, wherein said covering material is made of polyethylene.

17. A shelter as defined in claim 1, wherein said coupling means are PVC elbows.

18. A shelter as defined in claim 1, wherein said hinge means comprise scoring lines in said covering means which extend between.

* * * * *